US007126550B2

(12) United States Patent
Clerc et al.

(10) Patent No.: US 7,126,550 B2
(45) Date of Patent: Oct. 24, 2006

(54) CLASP FOR BRACELET INCORPORATING AN ANTENNA AND BRACELET INCLUDING THE SAME

(75) Inventors: Nicolas Clerc, Le Locle (CH); Nicolas Oian, St-Blaise (CH); David Apothéloz, Corcelles (CH)

(73) Assignee: Tissot S.A., Le Locle (CH)

( * ) Notice: Subject to any disclaimer, the term of this patent is extended or adjusted under 35 U.S.C. 154(b) by 305 days.

(21) Appl. No.: 10/892,330

(22) Filed: Jul. 16, 2004

(65) Prior Publication Data

US 2005/0014541 A1 Jan. 20, 2005

(30) Foreign Application Priority Data

Jul. 18, 2003 (EP) ..... 03016357

(51) Int. Cl.
*H01Q 1/12* (2006.01)

(52) U.S. Cl. ..... 343/718; 343/718; 343/720; 343/788; 455/344; 455/575.7; 455/575.1

(58) Field of Classification Search ..... 343/718, 343/720, 788; 455/344, 575.7, 575.1
See application file for complete search history.

(56) References Cited

U.S. PATENT DOCUMENTS 5,152,693 A 10/1992 Matsui et al.
5,179,733 A 1/1993 Matsui
5,303,421 A 4/1994 Goldenberg

FOREIGN PATENT DOCUMENTS

EP 125 930 A2 11/1984
EP 867 968 A2 9/1998
WO WO 86/03645 A1 6/1986

*Primary Examiner*—Hoang V. Nguyen
*Assistant Examiner*—Dieu Hien T. Duong
(74) *Attorney, Agent, or Firm*—Sughrue Mion, PLLC

(57) ABSTRACT

There is disclosed a clasp for electrically connecting first (10) and second (10') antenna elements respectively housed in first (50) and second (50') strands of a wristband of a portable electronic instrument, this clasp including two parts (1, 2) able to be detached from each other, each electrically connected to one of the antenna elements, and able to be mechanically locked onto each other in order to establish an electric contact between the antenna elements. The first detachable part includes a first clasp element (60) including a first plate (62) extending into the extension of the first wristband strand. The second detachable part includes a second clasp element (70) including a second plate (72) extending into the extension of the second wristband strand and a holding device (73). The second detachable part further includes a third clasp element (75) rotatably mounted on the second clasp element (70) and arranged to lock onto the holding device of the second clasp element. The clasp elements are arranged such that, during locking, the first plate is superposed onto the second plate and the third clasp element sandwiches the first plate against the second plate when it is locked onto the holding device.

8 Claims, 7 Drawing Sheets

B-B

A-A

CLASP FOR BRACELET INCORPORATING AN ANTENNA AND BRACELET INCLUDING THE SAME

This application claims priority from European Patent Application No 03016357.0 filed on Jul. 18, 2003, the entire disclosure of which is incorporated herein by reference.

FIELD OF THE INVENTION

The present invention generally concerns a clasp for electrically connecting first and second antenna elements housed respectively in first and second strands of a wristband of a portable electronic instrument, this clasp including first and second parts that can be detached from each other, respectively electrically connected to the first and second antenna elements, and able to be mechanically locked onto each other to establish an electric contact between the first and second antenna elements. The present invention also concerns a wristband including such a clasp.

BACKGROUND TO THE INVENTION

Clasps answering the general definition given hereinbefore are already known. European Patent No. 0 125 930 discloses, for example, such a clasp for ensuring the electrical connection of two conductors housed in the strands of a wristband for forming loop antenna around the user's wrist when the electronic instrument is being worn.

U.S. Pat. Nos. 5,152,693 and 5,179,733 disclose another solution that, like the aforementioned solution, has the possibility of adjusting the position of one of the clasp elements on one of the wristband strands. Yet another similar solution is given in U.S. Pat. No. 5,303,421.

Finally, another solution is known wherein the clasp is of the type with a buckle with a tongue (cf. particularly WO 86/03645), of the type with male and female parts that plug into one another (cf. again WO 86/03645), or of the type with an unfolding buckle (cf. particularly EP 0867 968).

The buckle with a tongue solution is not suitable in practice because of the poor quality of the electric contact, and the plug-in type solution is complex from a mechanical point of view. As for the other aforementioned solutions, it should be noted that these solutions expose parts of the antenna elements on the internal or external face of the wristband. This type of solution thus has a drawback insofar as the exposed parts of the antenna elements can quickly become oxidized and thus cause the quality of the electric contact to deteriorate. This oxidization is accelerated, in particular, by the presence of sweat when the wristband is worn on the wrist. From an aesthetic point of view, this type of solution is also not very desirable.

Another drawback of these solutions lies in the relatively large thickness of the wristband around the fastening device, the two strands of the wristband being superposed there.

SUMMARY OF THE INVENTION

It is thus a general object of the present invention to propose a solution, on the one hand, for ensuring an adequate electrical connection between the two antenna elements housed in the wristband strands and which also, on the other hand, enables bulkiness to be reduced around the clasp.

The present invention thus concerns a clasp of the aforementioned type whose features are listed in claim 1. The present invention also concerns a wristband including such a clasp.

Advantageous embodiments of the present invention form the object of the dependent claims.

It is thus proposed to form the first detachable part of the clasp, which is electrically connected to the first antenna element, such that it includes a first clasp element including a first plate extending in the extension of the first wristband strand, the second detachable part, which is electrically connected to the second antenna element, including, on the one hand, a second clasp element including a second plate extending in the extension of the wristband strand element and a holding device, and, on the other hand, a third clasp element rotatably mounted on the second clasp element and arranged so as to lock onto the holding device of the second clasp element. When the first and second detachable parts are locked, the first plate of the first clasp element is superposed on the second plate of the second clasp element and the third clasp element is pivoted to sandwich the first plate against the second plate once locked onto the holding device.

This solution offers the advantage of assuring a very broad electric contact surface between the two detachable parts of the clasp once locked. In fact, the two plates, thus arranged, ensure by their relatively large surface area, good electric cohesion between the two detachable parts of the clasp. On the other hand, the third clasp element, when it is locked onto the second clasp element, exerts a pressure or compression force holding the plate of the first clasp element in tight contact with the plate of the second clasp element.

Preferably, the first plate is provided with a least one fixing orifice passing through the thickness of the first plate and the holding device includes at least one fixing stud arranged substantially perpendicularly to the second plate and one end of which is arranged to lock onto the third clasp element, the fixing orifice and the fixing stud being arranged such that, when the first and second plates are superposed, the fixing stud passes through the fixing orifice. This variant ensures a proper mechanical grip for the clasp.

BRIEF DESCRIPTION OF THE DRAWINGS

Other features and advantages of the present invention will appear more clearly upon reading the following detailed description of an embodiment of the invention, given solely by way of non-limiting example and illustrated by the annexed drawings, in which.

DESCRIPTION OF A PREFERRED EMBODIMENT

Within the scope of the non-limiting example that will be given in the following description, it will be noted now that the wristband includes two identical wristband strands each including the same antenna element, these two strands being attached to each other by the clasp, so that the two antenna elements are electrically connected to each other so as to form a loop antenna around the wrist. This type of antenna configuration in a wristband is well known and its operating principle will not therefore be explained here. Fuller information on this point can be found in the documents cited in the preamble.

Figure 1:
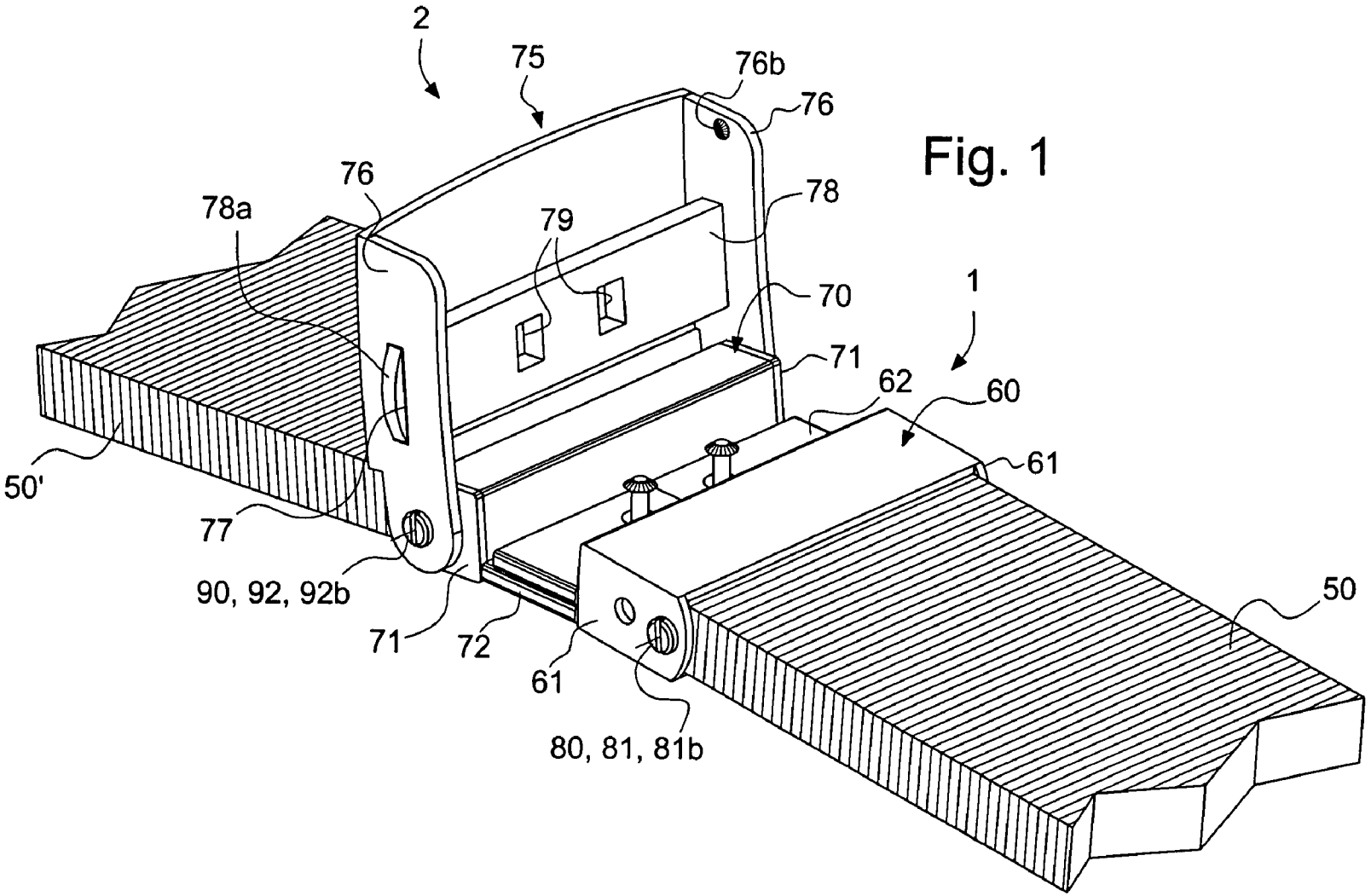
FIG. 1 shows a perspective view of a clasp according to an embodiment of the invention, the two detachable parts of the clasp being illustrated in a situation where they are secured to each other, the third rotatably mounted clasp element being illustrated in the unlocked position.
Figure 1A:
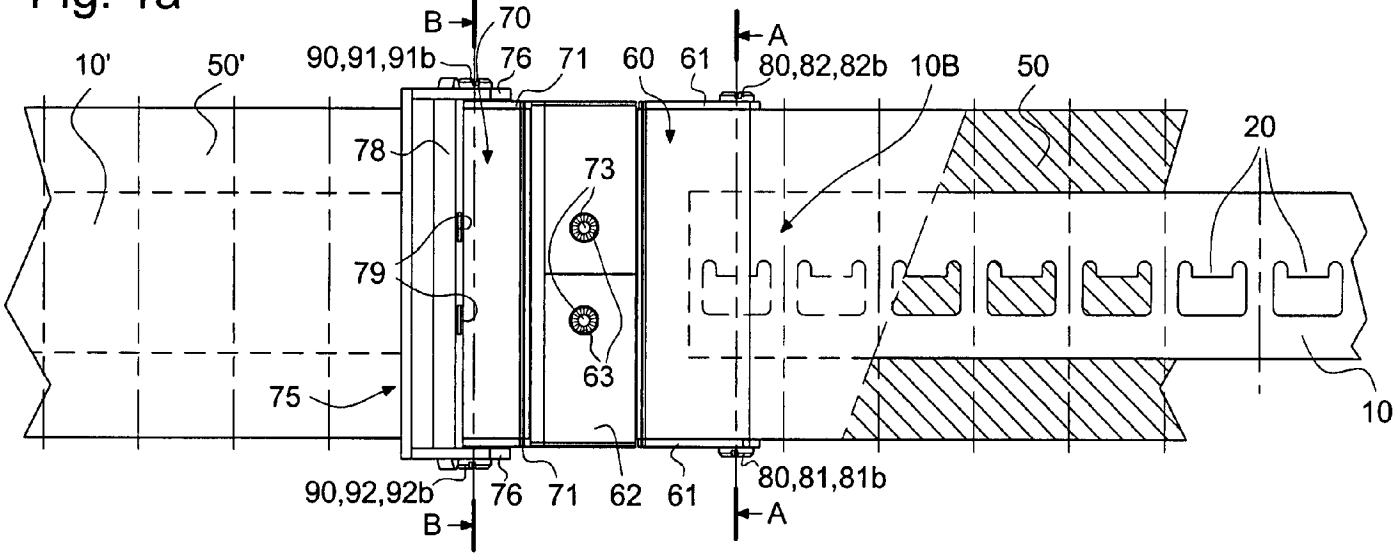
FIGS. 1*a* and 1*b* are respectively a plan view, on the side of the external face of the wristband, and a side view of the clasp of FIG. 1.
Figure 1B:
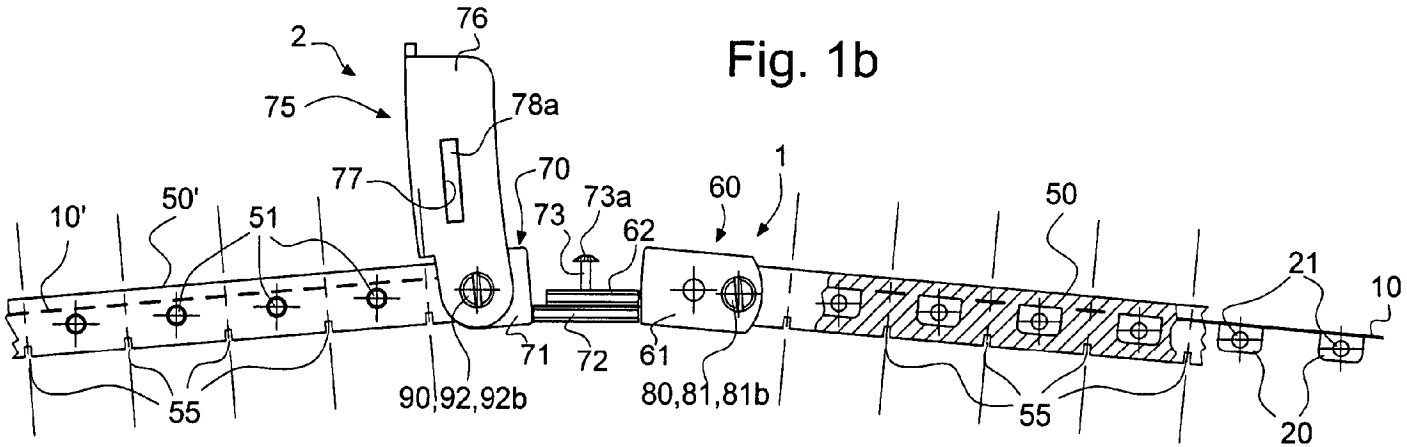
Figure 2:
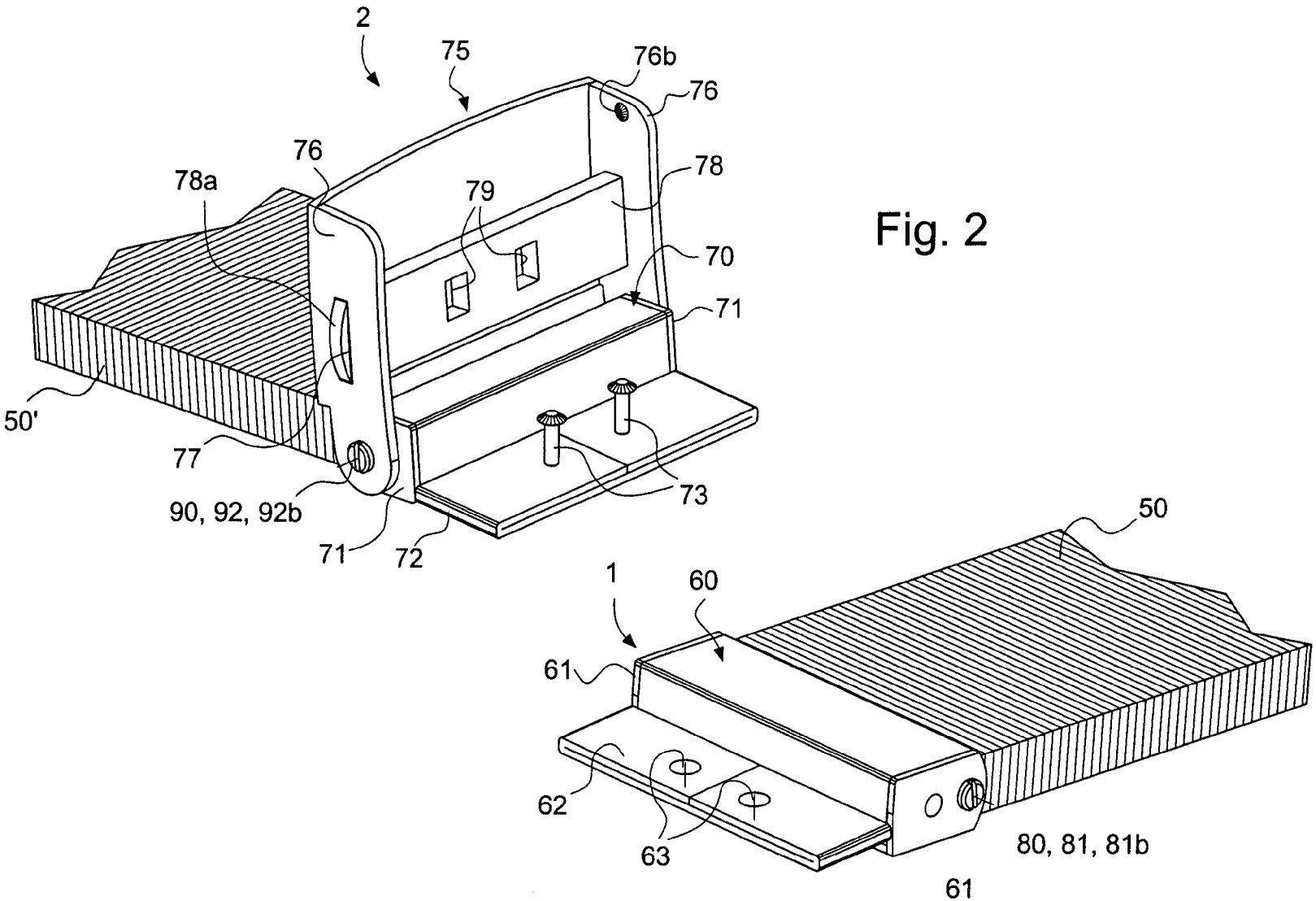
FIG. 2 shows a similar perspective view to that of FIG. 1, where the two detachable parts are illustrated detached from each other.

FIGS. 1, 1*a* and 1*b* show respectively a perspective view, a plan view on the side of the external wristband face (by definition the "external face" is defined as the face oriented towards the outside of the wrist when the wristband is being worn, as opposed to the "internal face" which designates the face of the wristband which is in contact with the wrist when the wristband is being worn) and a side view of the clasp according to an embodiment of the invention. FIG. 2 shows a similar view to that of FIG. 1, in which the detachable parts are illustrated detached from each other.

This clasp includes first and second detachable parts respectively designated by the reference numerals 1 and 2. The first detachable part 1 is electrically connected to a first antenna element 10 (not illustrated in FIG. 1) housed in the first wristband strand 10, whereas the second detachable part 2 is electrically connected to a second antenna element 10' (not illustrated in FIG. 1) housed in second wristband strand 50'.

As illustrated in these Figures, first detachable part 1 is essentially formed of a first clasp element 60 mounted on the end of first strand 50 and second detachable part 2 is essentially formed of a second clasp element 70 mounted on the end of second strand 50' and a third clasp element 75 rotatably mounted on second clasp element 70 so as to be able to be pivoted with respect to the latter. This third clasp element 75 forms the actual element allowing the clasp to be locked. In these Figures, this third clasp element 75 is illustrated in the unlocked position.

The three aforementioned clasp elements are illustrated individually in FIGS. 5*a*, 5*b*, 6*a*, 6*b*, 7*a* and 7*b*. It will be noted that they can advantageously be made in the form of metal plates cut out and bent in accordance with the desired geometry.

Figure 3:
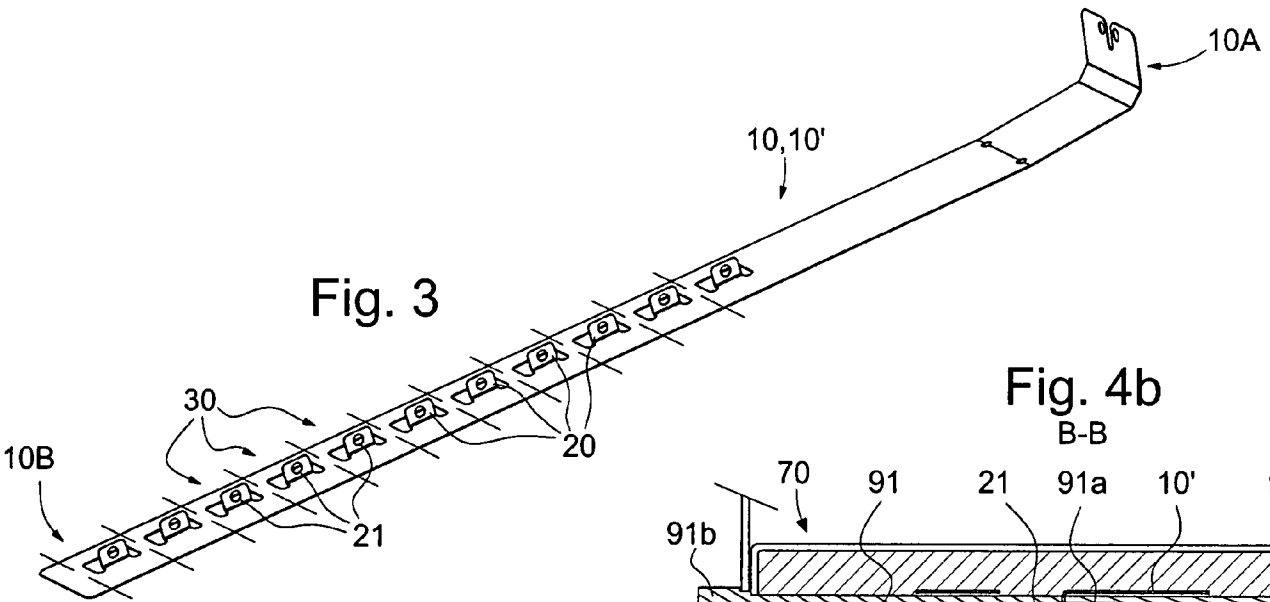
FIG. 3 shows a perspective view of a particular embodiment of an antenna element advantageously able to be incorporated in each wristband strand.

FIG. 3 is a perspective view of a non-limiting example of a conductor able to be used to make antenna elements 10 and 10'. This conductor is partially added to FIGS. 1*a* and 1*b*. A wristband including such a conductor is proposed in CH Patent Application Nos. 01241/03 and 01242/03 respectively entitled "Wristband, particularly for a watch, including an electric conductor incorporated in its thickness" and "Wristband, able to be adjusted in length, particularly a watchband, including an electric conductor incorporated in its thickness" both filed in the name of The Swatch Group Management Services AG on 15 Jul. 2003.

It will simply be mentioned here that the conductor forming each antenna element is formed of a self-supporting conductive plate formed of a plate of electrically conductive material (for example steel, copper, etc.), which is cut out and bent into the suitable shape. This conductive plate has an essentially rectangular shape whose longitudinal axis corresponds to the longitudinal direction of the wristband strand into which the conductive plate will be incorporated. In this embodiment, a first end 10A of the conductive plate is bent over and intended to allow the antenna element to be connected to the corresponding components housed in the case of the portable electronic instrument. This case is not illustrated in the Figures. One simply needs to know that this case preferably has a similar configuration to that of a watchcase, end 10A of each antenna element 10, 10' being thus located on each attachment of the wristband strand to the case.

The way in which the antenna elements are electrically connected in the case of the electronic instrument is not decisive for the purposes of the present invention. According to the configuration illustrated here by way of non-limiting example, the bent over end 10A of each antenna element 10, 10' is provided with two orifices for assuring the electric connection of the conductive plate via screws to the corresponding contact paths or clamps in the case of the portable electronic instrument.

In the example illustrated, the other end designated 10B of the conductive plate is intended, as already mentioned, to be electrically connected to the other identical conductive plate housed in the other wristband strand. In FIGS. 1*a*, 1*b* and 3, it can thus be seen that each antenna element 10,10' includes a plurality of lugs 20, eleven in number here, arranged longitudinally along the conductive plate. These lugs 20 are made by cutting out the conductive plate and bending the cut out parts outside the general plane of the conductive plate along a line parallel to the longitudinal direction of the wristband. Lugs 20 are thus essentially bent over at right angles towards one (internal or external) of the faces of the wristband. In this case, these lugs 20 are bent over towards the internal face of the wristband.

The plurality of lugs 20 allows several possibilities for roughly adjusting the length of the wristband, the unused external part of the wristband being able to be cut. Within the scope of the present invention, one could envisage that each antenna element 10, 10' includes only one lug, or that a single antenna element includes a plurality of lugs as illustrated in the Figures and that the other antenna element has only one. Whatever happens, the fact of providing one or several lugs on each antenna element is not decisive for the purposes of the present invention.

Each lug 20 is intended to allow electrical connection to the corresponding antenna element 10, 10'. Each of these lugs 20 thus defines an electric contact zone with conductive plate 10. In FIGS. 1*a*, 1*b* and 3, the eleven contact zones thus defined are delimited by the dotted lines and are indicated by the reference numeral 30.

Each lug 20 preferably includes a through orifice 21, which allows the electrical connection of the antenna element via an electrically conductive pin arranged transversely in the wristband strand between the internal and external faces of the wristband as will be seen hereinafter.

In FIGS. 1*a* and 1*b*, it can be seen that the internal and external faces of the conductive plate forming antenna element 10 (the same is true for the other antenna element 10') are totally covered by the material forming wristband strand 50 (this material being advantageously deposited by overmoulding around the conductive plate). Several electrical access points to antenna element 10 are arranged laterally on wristband strand 50 on the side of the end connected to the clasp (again the same is true for the second strand 50'). As illustrated in the Figures, it can thus be seen that a plurality of orifices 51, preferably through orifices, are arranged transversely between the internal and external faces of the wristband strand to allow access to each of lugs 20 arranged on the antenna elements. The clasp is only connected to the end lug of each antenna element 10, 10'.

On the internal face of each wristband strand 50, 51, as illustrated in FIG. 1*b*, a set of transverse grooves 55 is provided, coinciding with the limits of each electric contact zone 30 with the antenna elements (these grooves 55 and orifices 51 are not illustrated in FIGS. 1 and 2 for the sake of simplification). Grooves 55 play the role of markers facilitating an operation of cutting the wristband between each electric contact zone 30. These markers can be made on one and/or the other of the internal and external faces of the wristband strand. Moreover, instead of grooves, the markers could simply be formed of suitable impressions on one or other of the faces of wristband strand 50.

Figure 4B:
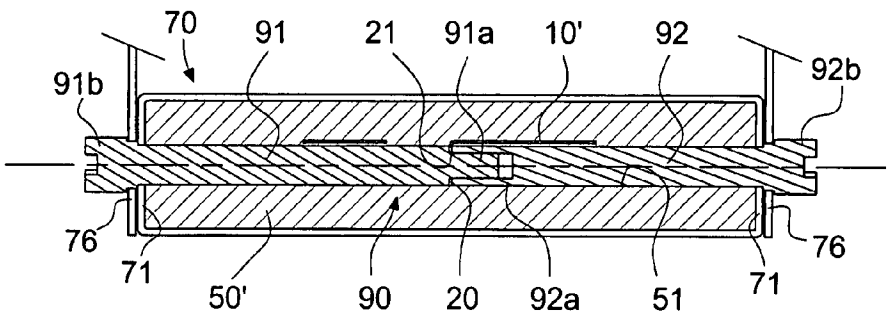
FIG. 4*b* is a cross-section of the second and third clasp elements taken where they are attached to the second wristband strand and electrically connected to the antenna element which is incorporated therein (cross-sectional line B—B in FIG. 1*a*)

With reference again to FIGS. 1, 1*a*, 1*b* and 2, as well as to FIGS. 4*a* and 4*b*, the structure and mode for connecting the clasp to the wristband strands will now be described.

As already mentioned, the first clasp element 60 is mounted on the end of the first strand 50. As illustrated in the Figures (cf. also FIGS. 6*a* and 6*b*), this first clasp element 60 includes a part forming a sleeve surrounding at least partly (here totally) the end of wristband strand 50. This sleeve part includes side walls 61 arranged laterally on either side of the end of the wristband strand and provided with through orifices 61*a* for the passage of a fixing pin designated by the reference numeral 80. The first clasp element 60 further includes a plate 62 extending, once mounted, into the extension of the first wristband strand 50. This plate is also provided with two fixing orifices 63 passing through the thickness of plate 62, their axis thus being substantially perpendicular to the plane of plate 62.

Figure 4A:
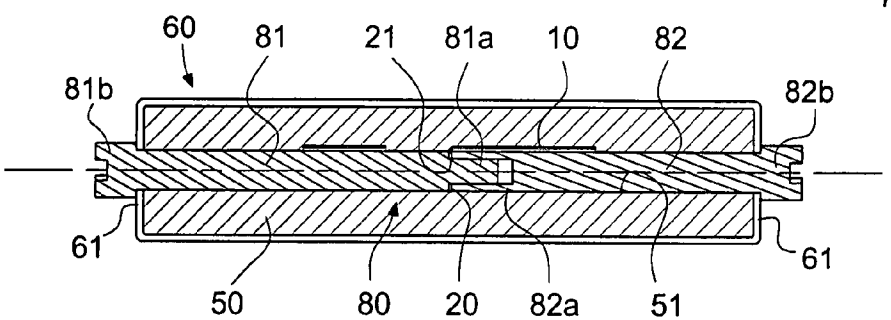
FIG. 4*a* is a cross-section of the first clasp element taken where it is attached to the first wristband strand and electrically connected to the antenna element, which is incorporated therein (cross-sectional line A—A in FIG. 1*a*)
Figure 5A:
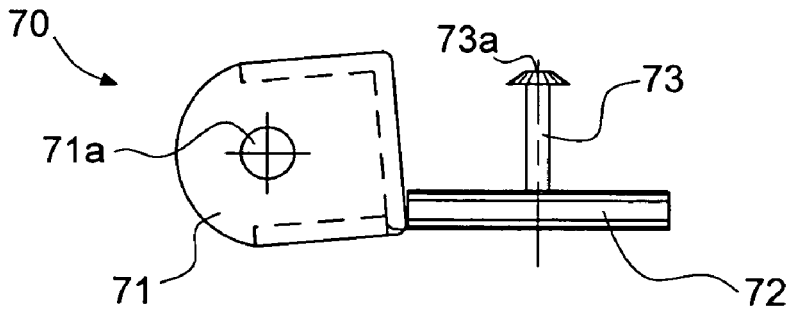
FIGS. 5*a* and 5*b* are respectively side and top views of the second clasp element.
Figure 5B:
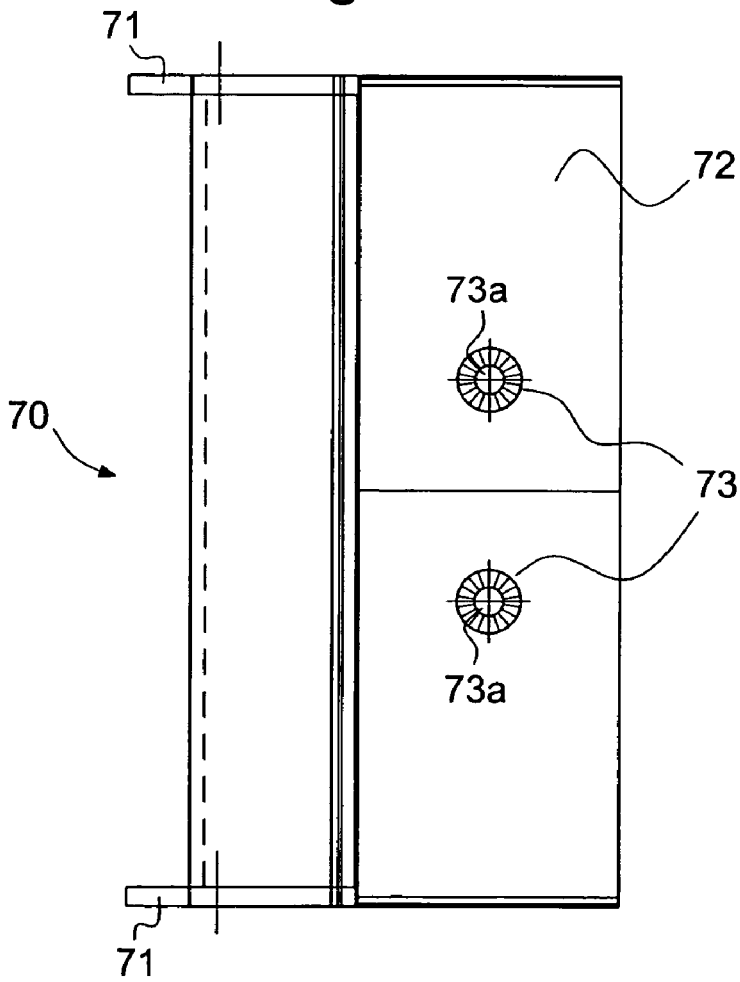
Figure 6A:
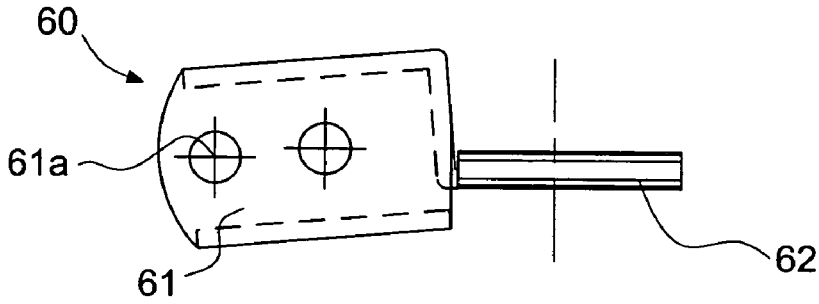
FIGS. 6*a* and 6*b* are respectively side and top views of the first clasp element.
Figure 6B:
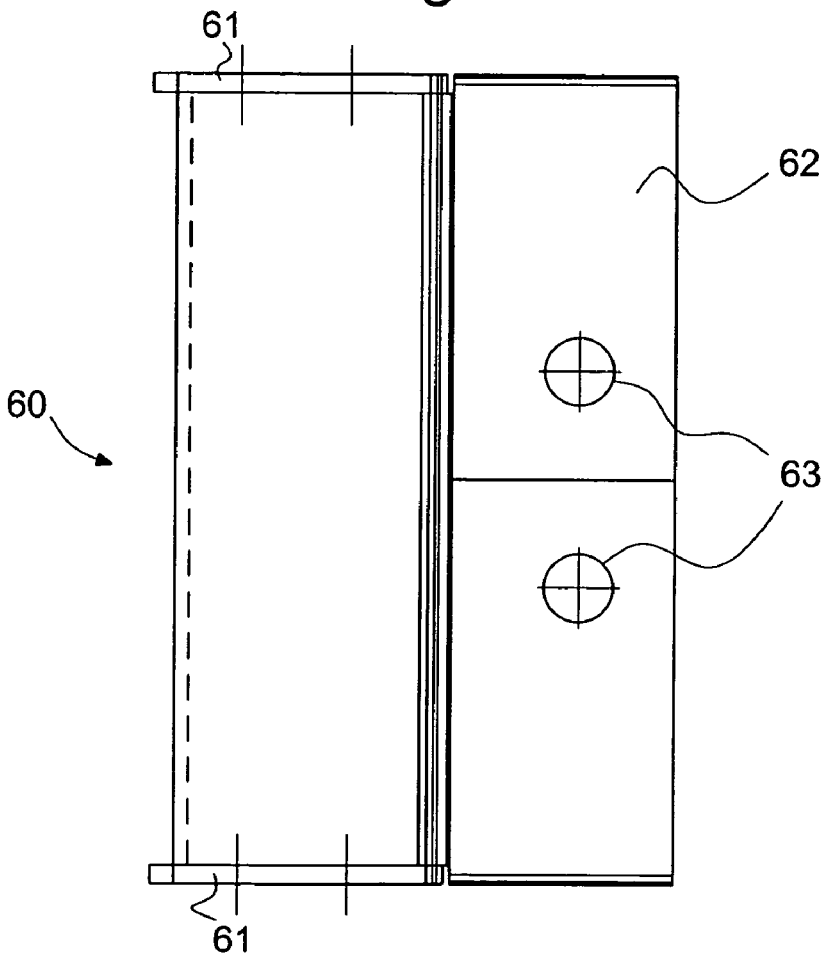
Figure 7A:
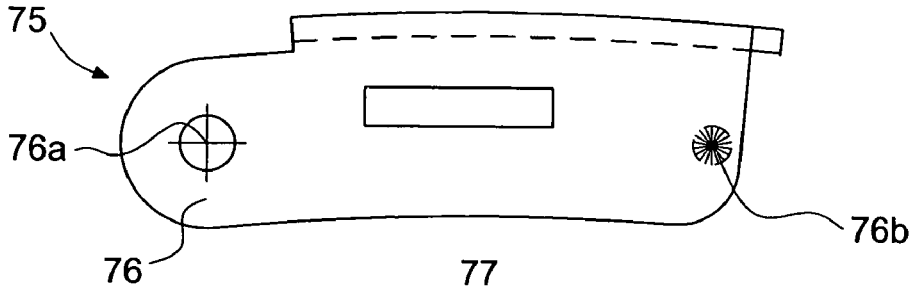
FIGS. 7*a* and 7*b* are respectively side and top views of the third clasp element.
Figure 7B:
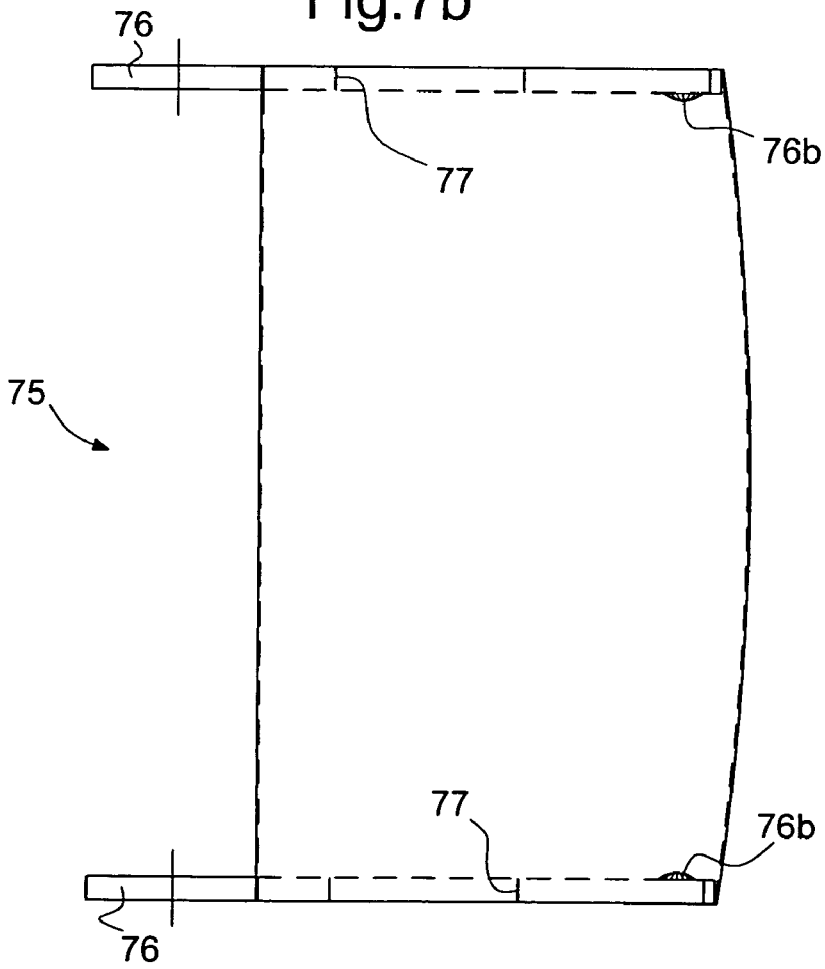

As illustrated in FIG. 4*a*, the electric connection between the first clasp element 60 and the first antenna element 10 is assured by an electrically conductive pin designated as a whole by the reference numeral 80. This pin 80 is preferably made in two parts 81, 82 in order to sandwich one of lugs 20 of antenna element 10 (in this case, the last lug located at the end of the antenna element). It is advantageously a screw 81 and a counter-screw 82 able to be secured to each other. In the example of FIG. 4*a*, screw 81 is provided with a threaded end 81*a* arranged to pass through orifice 21 arranged on lug 20 and to be inserted into a corresponding internal screw thread 82*a* made on counter-screw 82. Lug 20 is thus sandwiched between a shoulder of screw 81 at the base of threading 81 a and the end of counter-screw 82 consequently assuring electric contact with conductive plate 10. The electric contact with the first clasp element 60 is assured by the pressure of the heads designated 81*b* and 82*b* of screw 81 and counter-screw 82 against lateral walls 61.

By way of alternative to using a conductive pin 80 formed of two parts, one could envisage directly screwing screw 81 into lug 20 and only using one counter-screw 82, in which case transverse orifice 51 could be not a through orifice. Making pin 80 in two parts meaning that lug 20 can be sandwiched appears, however, preferable for assuring a proper electric contact between antenna element 10 and clasp element 60.

An attachment mode and a similar electric connection mode is adopted for electrically connecting the second clasp element 70 to the second antenna element 10' incorporated in the other strand 50'. In FIGS. 1, 1*a*, 1*b* and 2, it can be seen in this regard that the second clasp element 70 is mechanically and electrically connected to second strand 50' via an electrically conductive pin 90 also including a screw 91 and a counter-screw 92, whose heads 91*b* and 92*b* can be seen. This electrically conductive pin 90 is, however, slightly modified with respect to pin 80 to allow the third clasp element 75 to be rotatably mounted on second clasp element 70. On heads 91*b* and 92*b*, one can thus see that pin 90 has cylindrical portions of greater diameter than the diameter of the part of the pin that is housed in the wristband around which the third clasp element 75 is mounted.

As illustrated in the Figures (cf. also FIGS. 5*a* and 5*b*), the second clasp element 70 includes, like element 60, a part forming a sleeve surrounding at least partly (here totally) the end of wristband strand 50'. This sleeve part again includes side walls 71 arranged laterally on either side of the end of wristband strand 50' and provided with through orifices 71*a* for the passage of fixing pin 90. The second clasp element 70 also includes a plate 72 extending, once mounted on its end, in the extension of second wristband strand 50'. This plate is also provided with two fixing studs 73 arranged substantially perpendicularly to the plane of plate 72. These studs 73 form a holding device on which the third clasp element 75 locks.

As illustrated, the third clasp element 75 (cf. also FIGS. 7*a* and 7*b*) essentially has the shape of a cap provided with two side walls 76 arranged to come on either side of second clasp element 70. Mounting orifices 76*a* are arranged in these side walls 76 to enable this third clasp element 75 to be rotatably mounted on the second clasp element 70. Bulging portions of material designated by the reference numeral 76*b* are arranged towards the interior of side walls 76 so as to assure both mechanical and electric contact between third clasp element 75 and first clasp element 60. Electric contact between the second and third clasp elements 70, 75 can also be improved by pre-stressing walls 76 inwards.

When the first and second detachable parts of the clasp are locked, it will thus be clear that the first plate 62 of first clasp element 60 is superposed on the second plate 72 of the second clasp element 70 and that the third clasp element 75 is pivoted to sandwich first plate 62 against second plate 72 once locked on holding device 73. As already mentioned, this solution offers the advantage of assuring a very broad electric contact surface between the two detachable parts of the clasp once locked.

In the Figures, it can be seen that the third clasp element 75 also includes an additional element, designated by the reference numeral 78, which is held between two mounting apertures 77 arranged in the side walls 76 of the third clasp element 75. This element 78 includes two apertures 79 for receiving the two fixing studs 73. Housed between this element 78 and the third clasp element 75 there is a conventional unlockable mechanism for holding the end 73*a* of fixing studs 73 once the third clasp element has pivoted on these studs. This mechanism is not illustrated in detail since it is well known. It will simply be mentioned that the holding of third clasp element 75 on studs 73 can be interrupted by actuating the mechanism via two push-buttons that can be actuated manually and whose ends 78*a* can be seen protruding on either side of third clasp element 75 through apertures 77.

For the purpose of further improving the electric cohesion between the two detachable parts 1 and 2 of the clasp, one could envisage also providing an elastic element inserted for example between the first 60 and third 75 clasp elements in order to press the first and second plates 62, 72 against each other. Such an elastic element could also be inserted between the two plates 62 and 72 to press, this time, plate 62 against third clasp element 75.

It will be understood that various modifications and/or improvements evident to those skilled in the art can be made to the embodiment described in the present description without departing from the scope of the invention defined by the annexed claims.

What is claimed is:

1. A clasp for electrically connecting first and second antenna elements respectively housed in first and second strands of a wristband of a portable electronic instrument, this clasp including first and second parts able to be detached from each other, respectively electrically connected to said first and second antenna elements, and able to be mechanically locked onto each other in order to establish an electric contact between said first and second antenna elements, wherein said first detachable part electrically connected to said first antenna part includes a first clasp element including a first plate extending into the extension of said first wristband strand, and wherein said second detachable part electrically connected to said second antenna element includes:

a second clasp element including a second plate extending into the extension of said second wristband strand and a holding device; and a third clasp element rotatably mounted on said second clasp element and arranged to lock onto said holding device of said second clasp element, said clasp elements being arranged such that, when said first and second detachable parts are locked, said first plate is superposed on said second plate and that said third clasp element sandwiches said first plate against said second plate when it is locked onto said holding device.

2. A clasp according to claim 1, wherein said first plate is provided with at least one fixing orifice passing through the thickness of said first plate and wherein said holding device includes at least one fixing stud arranged substantially perpendicularly to said second plate and one end of which is arranged to lock onto said third clasp element, said at least one fixing orifice and said at least one fixing stud being arranged such that, when said first and second plates are superposed said at least one fixing stud passes through said at least one fixing orifice.

3. A clasp according to claim 1, wherein each of said first and second clasp elements is mounted on one end of the corresponding wristband strand and includes a part forming a sleeve surrounding at least partly the end of the wristband strand, this sleeve part including side walls arranged laterally on either side of the end of the wristband strand and provided with through orifices for the passage of a fixing pin.

4. A clasp according to claim 1, wherein said first and second clasp elements are each respectively electrically connected to said first and second antenna elements via an electrically conductive pin made in two parts and sandwiching a contact zone arranged on the antenna element.

5. A clasp according to claim 4, wherein each electrically conductive pin includes a screw and a counter-screw cooperating with said screw to sandwich said contact zone.

6. A wristband for portable electronic instrument including first and second strands, one end of which is intended to be secured to a case of said portable electronic instrument and the other end of which is secured to a clasp for electrically connecting first and second antenna elements respectively housed in first and second strands, this clasp including first and second parts able to be detached from each other, respectively electrically connected to said first and second antenna elements, and able to be mechanically locked onto each other in order to establish an electric contact between said first and second antenna elements, wherein said first detachable part electrically connected to said first antenna part includes a first clasp element including a first plate extending into the extension of said first wristband strand, wherein said second detachable part electrically connected to said second antenna element includes:

a second clasp element including a second plate extending into the extension of said second wristband strand and a holding device; and a third clasp element rotatably mounted on said second clasp element and arranged to lock onto said holding device of said second clasp element, said clasp elements being arranged such that, when said first and second detachable parts are locked, said first plate is superposed on said second plate and that said third clasp element sandwiches said first plate against said second plate when it is locked onto said holding device, and wherein said first and second antenna elements housed between external and internal faces of the wristband.

7. A wristband according to claim 6, including a clasp wherein said first and second clasp elements are each respectively electrically connected to said first and second antenna elements via an electrically conductive pin made in two parts and sandwiching a contact zone arranged on the antenna element, wherein first and second antenna elements each include a conductive plate of elongated shape arranged longitudinally in the wristband strand, and wherein said contact zone with each antenna element includes a lug cut out of the conductive plate and bent over along a longitudinal line in the direction of one of said external and internal faces of the wristband, each electrically conductive pin being arranged to sandwich said lug.

8. A wristband according to claim 7, wherein each electrically conductive pin includes a screw and a counter-screw cooperating with said screw to sandwich said contact zone.

* * * * *